US006749124B2

(12) United States Patent
Weiss

(10) Patent No.: US 6,749,124 B2
(45) Date of Patent: Jun. 15, 2004

(54) DAMPER CONTROL DEVICE

(76) Inventor: Cory A. Weiss, 13022 Adams Dr., Warren, MI (US) 48093

( * ) Notice: Subject to any disclaimer, the term of this patent is extended or adjusted under 35 U.S.C. 154(b) by 191 days.

(21) Appl. No.: 10/021,630

(22) Filed: Dec. 12, 2001

(65) Prior Publication Data

US 2003/0108835 A1 Jun. 12, 2003

(51) Int. Cl.[7] ..... F23N 5/10; F23N 3/00
(52) U.S. Cl. ..... 236/1 G; 431/80; 431/20
(58) Field of Search ..... 236/1 G; 431/80, 431/20, 22

(56) References Cited

U.S. PATENT DOCUMENTS 2,349,443 A 5/1944 McCarty
4,204,833 A 5/1980 Kmetz
4,290,552 A * 9/1981 Prikkel, III ..... 236/1 G
4,299,554 A * 11/1981 Williams ..... 431/20
4,406,396 A 9/1983 Habegger
4,550,874 A 11/1985 Clouser
4,778,378 A 10/1988 Dolnick
4,846,400 A 7/1989 Crouse
5,393,221 A 2/1995 McNallay
6,257,871 B1 7/2001 Weiss
6,439,877 B1 * 8/2002 Weiss ..... 431/20

* cited by examiner

*Primary Examiner*—Chen Wen Jiang

(57) ABSTRACT

A damper control device is disclosed comprising a mounting plate, a motor assembly coupled to the mounting plate and having a shaft extending therefrom, and a single circuit board coupled to the mounting plate, comprising relay control circuitry which rotates the shaft to an open position in response to a first signal, rotates the shaft to a closed position in response to a second signal, and time delay circuitry which holds the shaft in the open position for a period of time after receipt of the second signal. Preferably the damper control device can be used with an oil-fired heating appliance.

14 Claims, 5 Drawing Sheets

DAMPER CONTROL DEVICE

FIELD OF THE INVENTION

This invention relates to appliances such as water heaters and furnaces and, more particularly, to a device for controlling dampers commonly used in such appliances.

BACKGROUND OF THE INVENTION

In a conventional heating appliance a pipe delivers a fuel such as fuel oil or gas from a fuel source to a burner positioned in a combustion chamber. The pipe routinely includes a valve which controls the flow of fuel to the burner.

Known heating appliances typically include an exhaust vent or flue to direct emissions resulting from combustion away from the combustion chamber of the appliance and into an area, such as the outdoors, where the emissions can dissipate. Exhaust vents, however, also allow heat to escape from the appliance thereby reducing the overall efficiency of the appliance. As a result, conventional gas and oil-fired appliances typically include dampers disposed within an airshaft forming the exhaust vent. The damper opens prior to ignition of the burner in the appliance to allow emissions from combustion to be evacuated from the appliance. After the burner is extinguished and combustion has ended, a signal (such as removal of a voltage) is sent from a thermostat or other agent to a relay control circuit which controls a motor. The motor moves the damper to a closed position, blocking the escape of combustion products through the exhaust vent, thereby trapping the remaining heat. In addition to the damper, conventional oil and gas fired appliances also control one or more valves within a fuel line in order to open and close the valves and the damper in response to predetermined conditions.

Recently gas fired appliances have been developed such as those disclosed in U.S. Pat. No. 6,257,871 B1 and U.S. patent application Ser. No. 09/644,740. Both of these cases are assigned to the assignee of the present invention, and the entire disclosures of both are hereby incorporated by reference. It would be desirable to have a damper control device which could use as many parts in common with the recently developed gas damper control devices yet be operational with other fuels, such as oil. However, gas-fired appliances have operating conditions and design constraints which are different from oil-fired appliances, resulting in somewhat different designs for each. This means that merely switching fuel lines is insufficient to convert from one fuel source to another. For example, in gas fired heating appliances, the heat and products of combustion are of a temperature that allows the damper to be moved to the closed position essentially immediately after the call for heat has been satisfied. However, oil-fired heating appliances operate at higher temperatures than gas-fired appliances. To protect the appliance a time delay device can be used. The time delay device controls the damper so that it stays open for a period of time after a call for heat has been satisfied and combustion has ended.

Known time delay circuitry has been mounted as an add on, separate and spaced apart from the relay control circuitry. However, the mounting assembly of the recently developed vent dampers for gas fired heating appliances is relatively compact, and the existing design used for oil-fired heating appliances would not fit within such a tight package. Also, known oil-fired heating appliances needed double pole relays to accept a required range of amperages and attendant furnace sizes. Accordingly, it would be desirable to have a damper control device suitable for use on heating appliances which use fuels other than gas while incorporating the established mounting assembly of vent dampers for gas heating appliances and also satisfying electrical requirements, i.e., prevent arcing between components.

SUMMARY OF THE INVENTION

In accordance with a first aspect, a damper control device comprises a mounting plate, a motor assembly coupled to the mounting plate and having a shaft extending therefrom, and a single circuit board coupled to the mounting plate, having relay control circuitry which rotates the shaft to an open position in response to a first signal, rotates the shaft to a closed position in response to a second signal, and time delay circuitry which holds the shaft in the open position for a period of time after receipt of the second signal. The shaft may be attached to a damper so that the shaft and damper move together. The relay control circuitry may operate on the same current as the first and second signals. Preferably the relay control circuitry uses a single pole relay.

Figure 1:
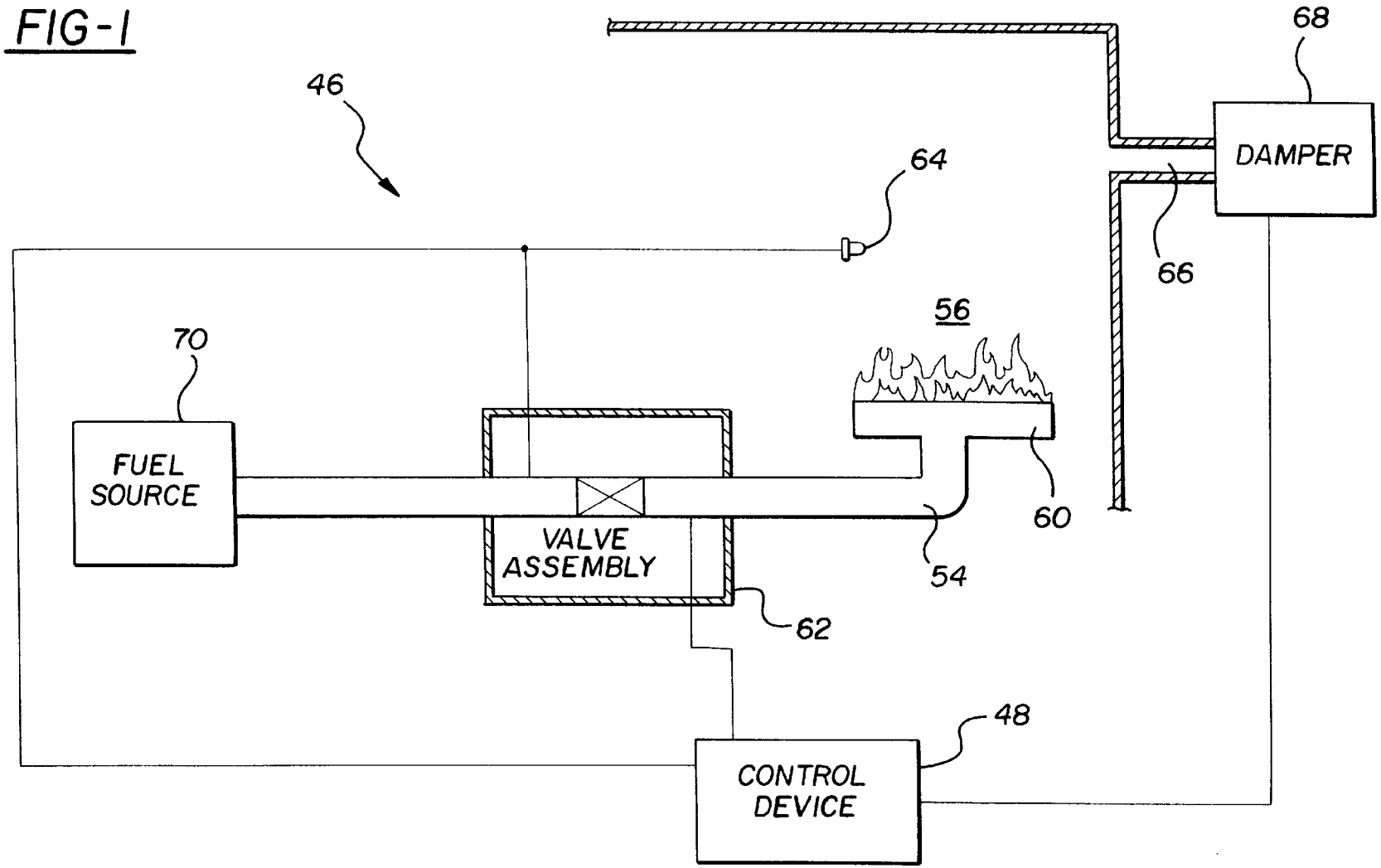
FIG. 1 is a schematic of a heating appliance incorporating a damper control device in accordance with a preferred embodiment.

It should be understood that the appended drawings are not necessarily to scale, presenting a somewhat simplified representation of various preferred features illustrative of the basic principles of the invention. The specific design features of the damper control device as disclosed here, including, for example, specific dimensions of the damper and the mounting plate will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation of the damper control device illustrated in the drawings. In general, front or frontward refers to a direction extending out of the plane of the paper in FIG. 1, and rear, rearward or backwards refers to a direction extending into the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the damper control device disclosed herein. The following detailed to discussion of various alternative and preferred features and embodiments will illustrate the general principles of the invention with reference to a damper control device for use with an oil fired furnace. Other embodiments suitable for other applications will be apparent to those skilled in the art given the benefit of this disclosure.

Referring now to the drawings, FIG. 1 shows a schematic of a heating appliance 46 such as a fuel oil-fired furnace incorporating a control device 48 in accordance with the present invention. In addition to control device 48, appliance 46 may include several sections of fuel pipe, a combustion chamber 56, a main burner 60, a valve assembly 62, a thermostat 64, an exhaust vent 66, and a damper 68 positioned in exhaust vent 66.

Pipe sections are provided to direct fuel received from a fuel source 70 to the burners 60 within appliance 46. Fuel source 70 may be located at a distance remote from appliance 46. A section 54 of pipe is also connected at one end to valve assembly 62 and at another end to burner 60. Combustion chamber 56 provides a space for burning the fuel provided by fuel source 70. Chamber 56 encompasses at least burner 60. Burner 60 is provided to generate heat within appliance 46 to increase the temperature of water, air, etc., depending upon the purpose for which appliance 46 is designed. Valve assembly 62 is provided to control the passage of fuel from fuel source 70 to main burner 60.

Figure 2:
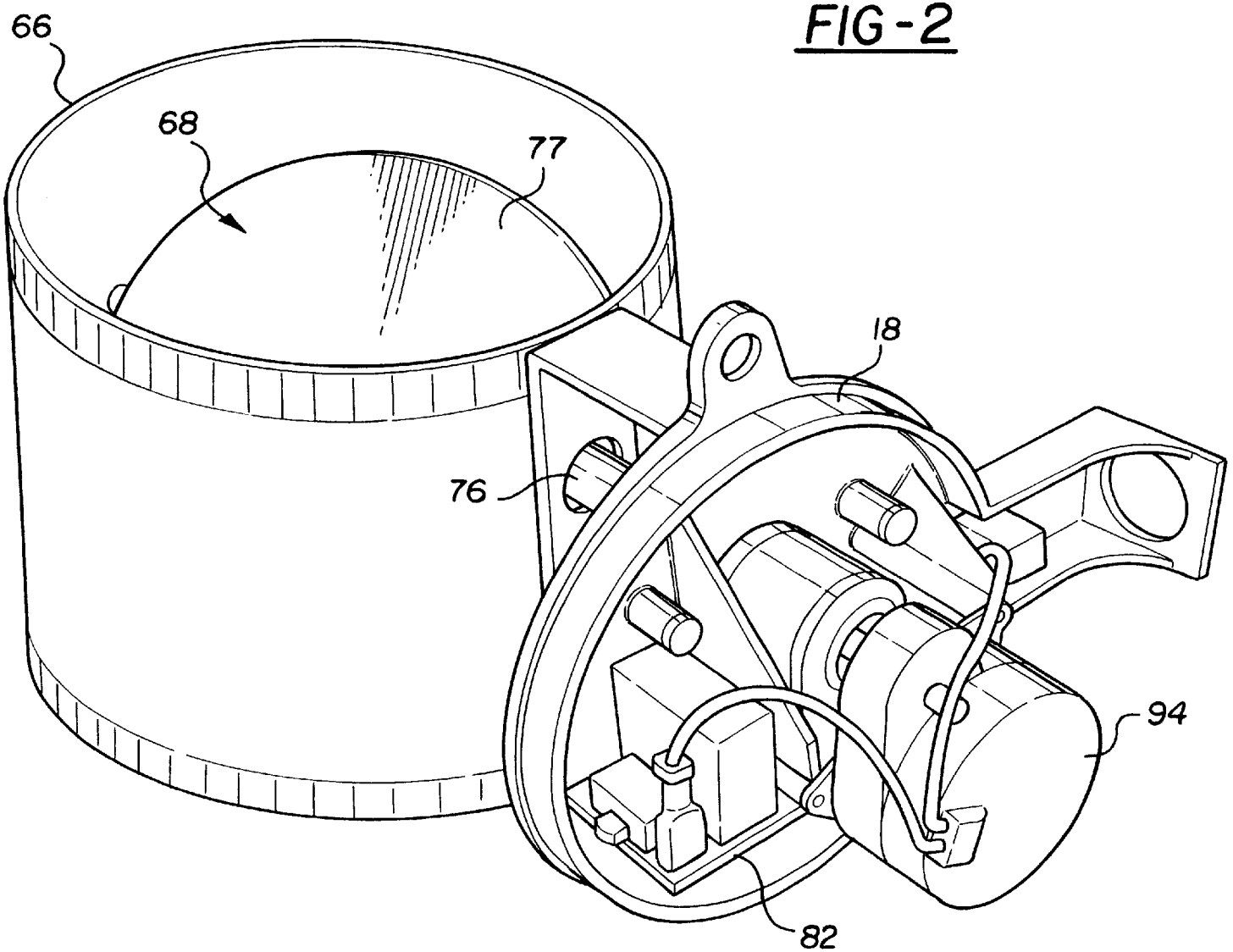
FIG. 2 is a perspective view of a damper control device in accordance with a preferred embodiment, showing the device attached to a damper mounted in an exhaust vent.

FIG. 2 is an isolated perspective view of the damper 68 and the damper control device. Damper 68 is provided to control the evacuation of heat from combustion chamber 56 through vent 66 in order to improve the efficiency of appliance 46. Damper 68 may comprise, for example, Model No. RVGP-PC damper sold by Effikal International, Inc., assignee of the present invention. Damper 68 is supported within vent 66 and includes a drive shaft 76 that is rotatable about an axis extending transversely to the longitudinal axis of vent 66 and to the direction of airflow through vent 66. As plate 77 rotates about its axis, both it and the damper assume a plurality of angular positions including a closed position (illustrated in FIG. 2) in which damper 68 allows a minimum outflow of air from combustion chamber 56 and an open position in which damper 68 allows a maximum outflow of air from combustion chamber 56. Mounting plate 18 is seen in FIG. 2 as supporting printed circuit board 82 and motor 94. The printed circuit board 82 preferably has time delay circuitry 99 and relay control circuitry 84, discussed in greater detail below.

Figure 3:
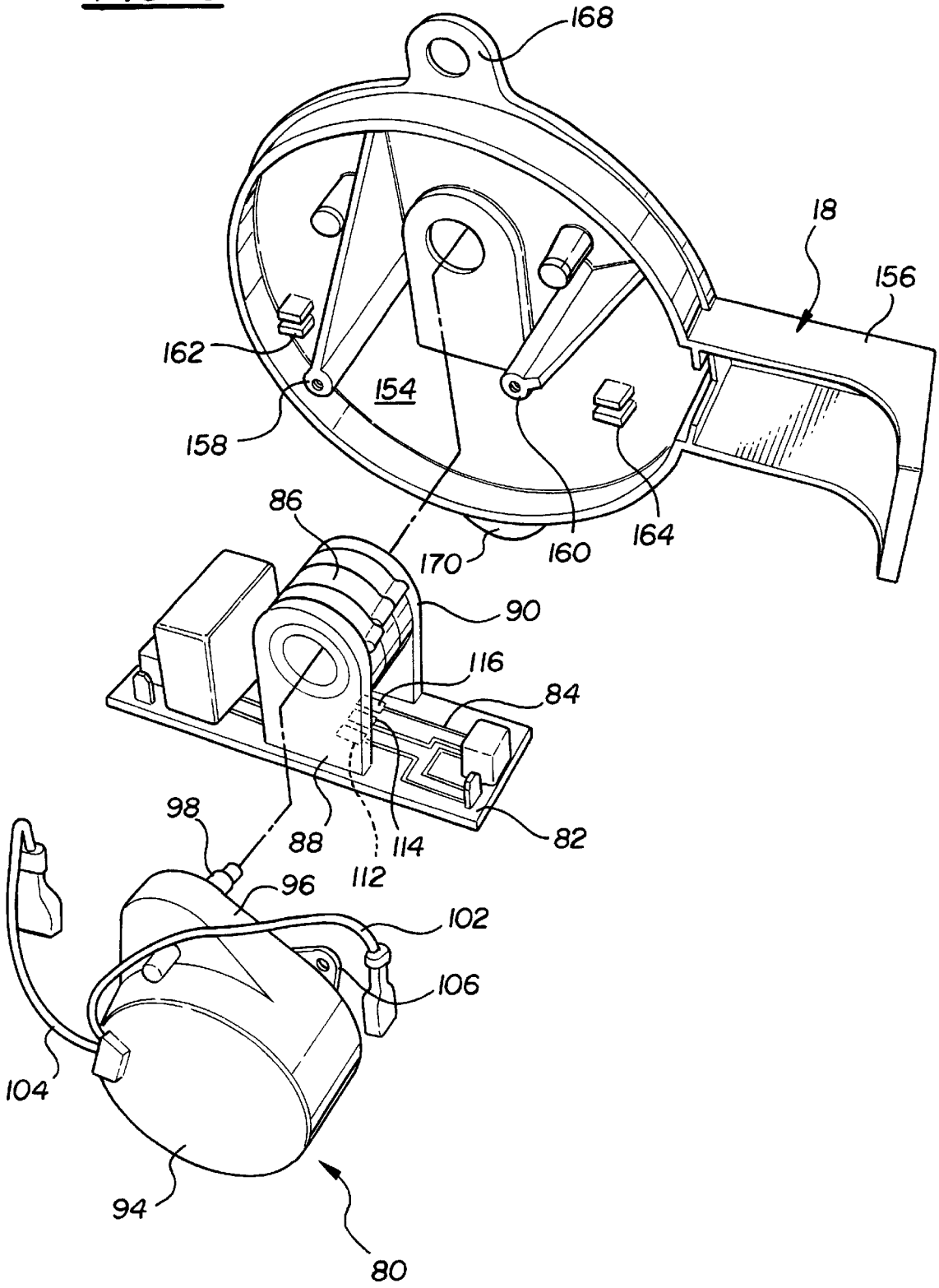
FIG. 3 is an exploded perspective view of the damper control device of FIG. 2, showing the plastic mounting plate and the single circuit board.
Figure 4:
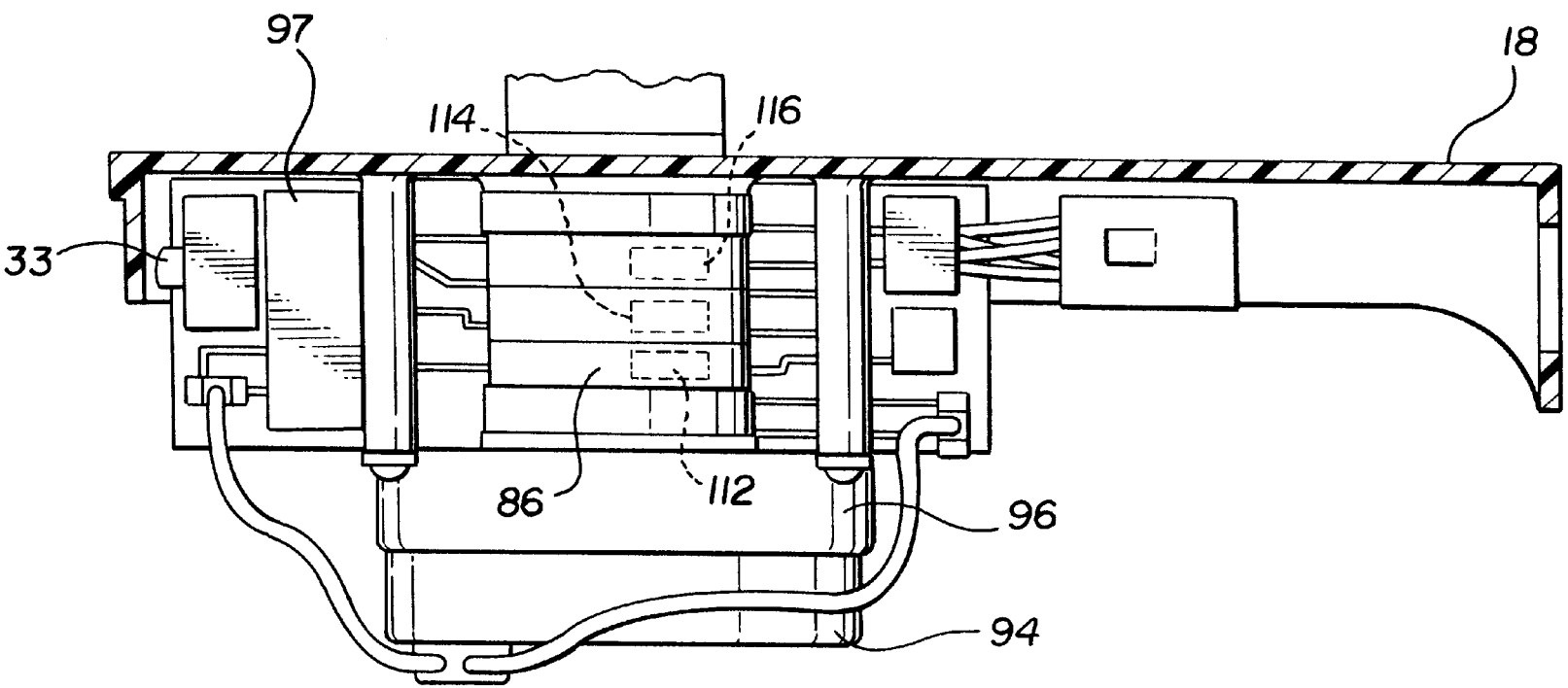
FIG. 4 is a top view of the circuit board of FIG. 3, showing time delay circuitry.
Figure 5:
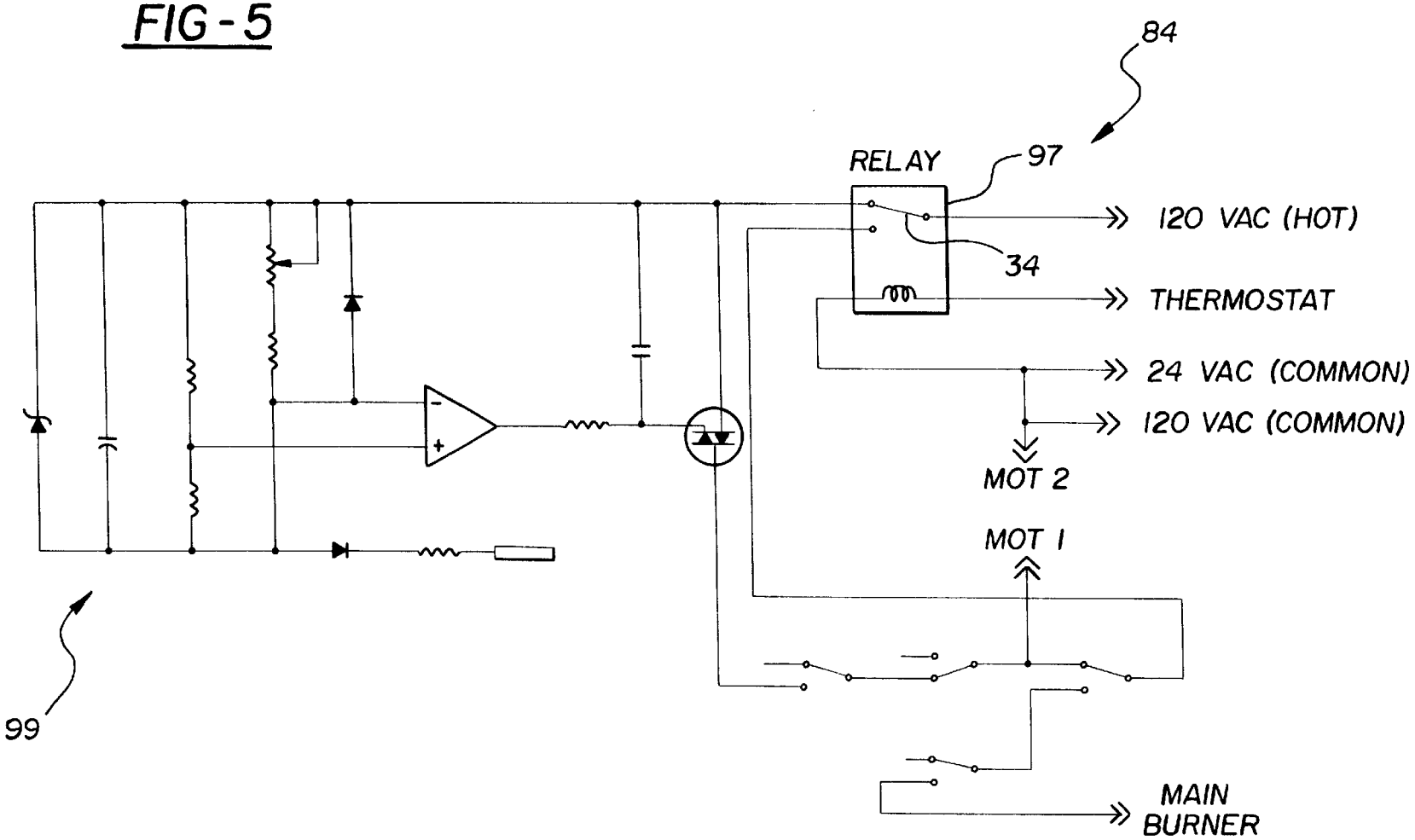
FIG. 5 is an example of a control circuit with a time delay circuit in accordance with a preferred embodiment.

FIGS. 3–5 focus on the relay control circuit 84 and its interface with its surrounding components. Output motor drive shaft 98 is provided to transfer torque to cam 86 and plate 77 of damper 68. Shaft 98 is seen to be driven by motor 94 acting through gear assembly 96, in response to control circuit 84, and the shaft 98 moves between open and closed positions with the damper 68. It will be understood, that in certain alternate preferred embodiments the shaft 98 may be driven directly by motor 94.

A call for heat (as from adjustment of thermostat 64) sends a first signal to the control device 48. Control device 48 is provided to control the operation of appliance 46, and particularly damper 68 and main burner valve 60. The control device 48 in accordance with the present invention may include a motor assembly 80, a printed circuit board 82, a control circuit 84, a cam 86, cam support members 88, 90 and a mounting plate 18. Circuit board 82 provides a mounting and support surface for several of the components in control circuit 84 and for cam 86. Board 82 further provides conduction paths to direct current among the components of control circuit 84 and other components of device 48, such as motor 94.

Motor assembly 80 is provided to cause rotation of cam 86 and plate 76 of damper 68. In particular, motor assembly 80 is provided to cause plate 76 to rotate about axis 42 to open and (in response to a second signal) close damper 68. Motor assembly 80 may comprise a motor 94, a gear assembly 96, and an output shaft 98.

Motor 94 is provided to generate a torque through which output shaft 98 is caused to rotate. A pair of lead wires 102, 104 may extend from motor 94 for connection to a power source (not shown).

Gear assembly 96 provides relative rotation to output shaft 98 responsive to motor 94. The gear assembly 96 may have one or more mounting flanges through which fasteners extend to connect motor assembly 80 to mounting plate 18.

Control circuit 84 is provided to selectively transmit current to main burner valve 74 and to motor 94 to control the operation of main burner 60 and damper 68, respectively. Control circuit 84 may include a plurality of control switches 112, 114, 116, that are mounted on board 82. Switches 112, 114, 116 may be disposed within a switch housing that is also mounted on board 82.

Cam 86 is provided to control the state of control switches 112, 114, 116 and may be made from a variety of conventional plastics and has a plurality of cam surfaces which are configured to selectively actuate respective control switches 112, 114, 116. Rotation of output shaft 98 causes rotation of cam 86 and, therefore, shaft and plate 76. Cam support members 88, 90 are provided, in accordance with the present invention, to support cam 86 on circuit board 82 and position cam 86 relative to control switches 112, 114, 116.

Mounting plate 18 provides support for several of the components of the damper control device 10 and secures it to the exhaust vent 66. Plate 18 is preferably made from a plastic so that the arm 156, motor mounting flanges 158, 160, and board receiving members 162, 164 are formed as unitary projections of a single piece member. Plastic mounting plate 18 further comprises a pair of mounting flanges 168, 170 by which plate 18 may be mounted within appliance 46 and an aperture through which the cam 86 extends. Arm 156 is provided to receive and position a wire harness, (sometimes referred to as a "pigtail") or other electrical connector to connect the components of control circuit 84 disposed on board 82 with those components of circuit 84 that are remote from board 82. Motor mounting flanges 158, 160 are provided to mount motor assembly 80 to plate 18. The flanges 158, 160 can include bores configured to align with apertures in mounting flanges of gear housing 106.

Board receiving members 162, 164 are provided to support and position circuit board 82. Members 162, 164 are substantially C-shaped in cross-section opening toward one another and extend from body portion 154. In an assembled position, preferably the circuit board 82 is positioned between the plastic mounting plate 18 and the motor assembly 80.

FIG. 4 shows the circuit board 82 and the relative positions of several components of the invention in accordance with a preferred embodiment. A slide switch 33 for manually overriding a signal from a thermostat is provided, along with relay 97. Cam 86 is shown in its location with respect to board 82, and switches 112, 114, 116 are shown in phantom. Relay 97 may be, for example, relay coil made by Omron Model G2R-24 for 24V AC switching voltage applications, or G2R-14 for 120 V AC. Known relays in oil-fired heating appliance are double pole pc (printed circuit board) relays, which have been unable to accommodate higher amperages, and therefore a corresponding wide range of furnace sizes. Advantageously, a single pole relay may be used here with either 120 V or 24 V applications, and satisfy the amperage requirements of the heating appliance. FIG. 5 shows a preferred embodiment of a control circuit 84 incorporated onto a circuit board 82, showing single pole relay 97 operating on 120 V AC with 24 V AC Common input. As noted, the furnace may be readily converted to run on 120 V AC input. The switch 34 in relay 97 shown in FIG. 5 are seen to be set to the off position, when there is no call for heat.

The cycle of operation can be seen to start with the thermostat 64 closing, causing relay 97 to latch. In turn, the motor 94 rotates the cam 86 and damper 68 to the open position. In known vent dampers for gas fired appliances, the relay control circuit operates on 24 V DC, whereas the input voltage is typically 24 V AC. Therefore, in known gas appliances rectification circuitry had to be included to convert from AC to DC. This means that the relays in those designs did not operate with the same current as the input signal. In accordance with a highly advantageous feature of at least certain preferred embodiments, the relay 97 can work on the same voltage as the input signal, for example 120 V AC, or 24 V AC.

Continuing with the cycle of operation, as the cam 86 rotates it actuates the switches which cut power to the motor 80 and sends power to the burner 60. The burner 60 continues to burn until the call for heat has been satisfied (registered as a temperature increase by the thermostat). Once this occurs, the thermostat opens, the relay delatches, the time delay circuitry 99 is initialized, and motor rotation is interrupted for the predetermined period of time set by the time delay circuitry. That is, advantageously, the damper 68 preferably does not assume the closed position immediately after main burner 60 is extinguished. Oils used in furnaces burn at higher temperatures than the gas used in gas fired appliances. To protect the system from damage associated with heat and the products of fuel oil combustion, the damper 68 is left in the open position for a period of time after the call for heat has been satisfied and the heating appliance has shut off. Once that period of time is complete, then the damper is rotated to the closed position in order to reduce or eliminate the evacuation of heat through vent 66. Time delay circuitry 99 is mounted on circuit board 82 to hold the damper in the open position for a predetermined period of time after the call for heat has been satisfied. Once the time delay has expired, a signal is sent to the motor urging the motor to rotate the cam 86 and damper 68 back to the closed position. Rotation of the cam resets the switches back to their original positions so that the heating cycle can be repeated.

An important advantage of at least certain preferred embodiments is that a single circuit board can be used which incorporates both the control circuitry and the time delay circuitry, all of which advantageously can be mounted to a plastic mounting plate 18 which can be formed common to both gas fired and oil fired appliances.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A damper control device comprising, in combination:

a mounting plate;

a motor assembly coupled to the mounting plate and having a shaft extending therefrom;

a single circuit board coupled to the mounting plate, comprising relay control circuitry which directs the shaft to move to an open position in response to a first signal and directs the shaft to move to a closed position in response to a second signal, and time delay circuitry which holds the shaft in the open position for a period of time after receipt of the second signal;

wherein the relay control circuitry has a single pole relay which can operate at any one of a plurality of input voltages.

2. The damper control device of claim 1 wherein the mounting plate has at least one motor mounting flange and the motor assembly is attached to the mounting plate at the at least one motor mounting flange.

3. The damper control device of claim 1 wherein the circuit board is coupled to the mounting plate so as to be positioned between the mounting plate and the motor assembly.

4. The damper control device of claim 1 wherein the first signal and second signal are produced by an electric current, and the relay control circuitry operates on the same electric current as the first and second signals.

5. The damper control device of claim 4 wherein the electric current is about 120 V AC.

6. The damper control device of claim 4 wherein the electric current is about 24 V DC.

7. The damper control device of claim 1 further comprising a cam mounted on the circuit board and coupled to the shaft for rotation therewith; and the circuit board has at least a first control switch mounted thereon;

wherein the cam is configured to selectively actuate the first control switch.

8. The damper control device of claim 7 wherein the circuit board has a second control switch and a third control switch, and the cam is configured to selectively actuate the second control switch and the third control switch.

9. A damper control device comprising, in combination:

a mounting plate;

a motor assembly coupled to the mounting plate and having a shaft extending therefrom;

a damper positioned in a vent, operatively connected to the shaft so as to move in response to rotation of the shaft, wherein the damper at least mostly closes the vent in a closed position and mostly allows air to pass in the vent in an open position; and a single circuit board coupled to the mounting plate, comprising time delay circuitry and relay control circuitry which in response to an electric signal urges the motor assembly to rotate the shaft so that the damper moves between an open position and a closed position;

wherein when the shaft is in the open position and the relay control circuitry receives the electric signal to move to the closed position, the time delay circuitry holds the shaft in the open position for a period of time.

10. The damper control device of claim 9 wherein the relay control circuitry operates on the same current as the electric signal.

11. The damper control device of claim 9 further comprising:

a thermostat which sends an electric signal to both the circuit board and a heating appliance which generates heating by combusting a fuel;

wherein in response to the electric signal the heating appliance turns on and turns off, and the time delay circuitry holds the shaft in the open position for the period of time after the heating appliance has turned off.

12. The damper control device of claim 11 wherein oil is the fuel that provides the heat for the heating appliance.

13. A damper control device comprising, in combination:

a mounting plate;

a motor assembly coupled to the mounting plate and having a shaft extending therefrom; and relay control circuitry which directs the shaft to move between an open position and a closed position, and time delay circuitry which holds the shaft in the open position for a preselected period of time after receipt of a signal to move the shaft to the closed position;

wherein the relay control circuitry has a single pole relay which can operate at any one of a plurality of input voltages.

14. The damper control device of claim 13 wherein the single pole relay can operate at 10 amps.

* * * * *